US008630857B2

(12) United States Patent
Kato et al.

(10) Patent No.: US 8,630,857 B2
(45) Date of Patent: Jan. 14, 2014

(54) SPEECH SYNTHESIZING APPARATUS, METHOD, AND PROGRAM

(75) Inventors: Masanori Kato, Tokyo (JP); Reishi Kondo, Tokyo (JP); Yasuyuki Mitsui, Tokyo (JP)

(73) Assignee: NEC Corporation, Tokyo (JP)

( * ) Notice: Subject to any disclaimer, the term of this patent is extended or adjusted under 35 U.S.C. 154(b) by 1183 days.

(21) Appl. No.: 12/527,802

(22) PCT Filed: Feb. 15, 2008

(86) PCT No.: PCT/JP2008/052574

§ 371 (c)(1),
(2), (4) Date: Aug. 19, 2009

(87) PCT Pub. No.: WO2008/102710

PCT Pub. Date: Aug. 28, 2008

(65) Prior Publication Data

US 2010/0076768 A1 Mar. 25, 2010

(30) Foreign Application Priority Data

Feb. 20, 2007 (JP) ..... 2007-039622

(51) Int. Cl.
*G10L 13/06* (2013.01)

(52) U.S. Cl.
USPC ..... 704/266; 704/258; 704/267; 704/268; 704/220; 704/260

(58) Field of Classification Search
USPC ..... 704/260, 258, 207, 267, 266, 205, 220, 704/268, 270.1
See application file for complete search history.

(56) References Cited

U.S. PATENT DOCUMENTS

| | | | | |
|---|---|---|---|---|
| 6,823,309 | B1 * | 11/2004 | Kato et al. | 704/267 |
| 7,054,815 | B2 * | 5/2006 | Yamada et al. | 704/267 |
| 7,127,396 | B2 * | 10/2006 | Chu et al. | 704/258 |
| 7,315,813 | B2 * | 1/2008 | Kuo et al. | 704/207 |
| 7,668,717 | B2 | 2/2010 | Mizutani et al. | |
| 7,856,357 | B2 | 12/2010 | Mizutani et al. | |
| 8,407,054 | B2 * | 3/2013 | Kato et al. | 704/266 |
| 2001/0037202 | A1 * | 11/2001 | Yamada et al. | 704/258 |

(Continued)

FOREIGN PATENT DOCUMENTS

| | | |
|---|---|---|
| JP | 8-263095 | 10/1996 |
| JP | 2001-092482 | 4/2001 |

(Continued)

OTHER PUBLICATIONS

International Search Report, PCT/JP2008/052574, May 27, 2008.

(Continued)

*Primary Examiner* — Vijay B Chawan
(74) *Attorney, Agent, or Firm* — Young & Thompson

(57) ABSTRACT

Disclosed is a speech synthesizing apparatus including a segment selection unit that selects a segment suited to a target segment environment from candidate segments, includes a prosody change amount calculation unit that calculates prosody change amount of each candidate segment based on prosody information of candidate segments and the target segment environment, a selection criterion calculation unit that calculates a selection criterion based on the prosody change amount, a candidate selection unit that narrows down selection candidates based on the prosody change amount and the selection criterion, and an optimum segment search unit than searches for an optimum segment from among the narrowed-down candidate segments.

18 Claims, 10 Drawing Sheets

(56) References Cited

U.S. PATENT DOCUMENTS

| | | | | |
|---|---|---|---|---|
| 2002/0143526 | A1* | 10/2002 | Coorman et al. | 704/211 |
| 2003/0195743 | A1* | 10/2003 | Kuo et al. | 704/207 |
| 2004/0148171 | A1* | 7/2004 | Chu et al. | 704/258 |
| 2005/0119891 | A1* | 6/2005 | Chu et al. | 704/260 |
| 2005/0137870 | A1 | 6/2005 | Mizutani et al. | |
| 2005/0182629 | A1* | 8/2005 | Coorman et al. | 704/266 |
| 2006/0069566 | A1* | 3/2006 | Fukada et al. | 704/260 |
| 2008/0177548 | A1* | 7/2008 | Yamada et al. | 704/260 |
| 2009/0070115 | A1* | 3/2009 | Tachibana et al. | 704/260 |
| 2010/0211393 | A1* | 8/2010 | Kato et al. | 704/260 |

FOREIGN PATENT DOCUMENTS

| | | |
|---|---|---|
| JP | 2004-109535 | 4/2004 |
| JP | 2004-126205 | 4/2004 |
| JP | 2004-139033 | 5/2004 |
| JP | 2004-347653 | 12/2004 |
| JP | 2004-354644 | 12/2004 |
| JP | 2005-091551 | 4/2005 |
| JP | 2005-164749 | 6/2005 |
| JP | 2005-292433 | 10/2005 |
| JP | 2006-084854 | 3/2006 |
| JP | 2007-025323 | 2/2007 |

OTHER PUBLICATIONS

Huang et al., "Spoken Language Processing", pp. 689-836, A Guide to Theory, Algorithm, and System Develoment.

Ishikawa, "Prosodic Control for Japanese Text-to-Speech Synthesis", pp. 27-34, Technical Report of IEICE, SP200072 (Oct. 2000).

Abe et al., "An introduction to speech synthesis units", pp. 35-42, Technical Report of IEICE, SP2000-73 (Oct. 2000).

Moulines et al., "Pitch-Synchronous Waveform Processing Techniques for Text-To-Speech Synthesis Using Diphones", pp. 453-467, Speech Communication 9 (1990).

Segi et al., "A Concatenative Speech Synthesis Method Using Context Dependent Phoneme Sequences With Variable Length As Search Units", pp. 115-120.

Kawai et al., "Ximera: A New TTS From ATR Based on Corpus-Based Technologies" pp. 179-184.

Koyama et al., "High Quality Speech Synthesis Using Reconfigurable VCV Waveform Segments with Smaller Pitch Modification", pp. 2264-2275.

Notice of Grounds for Rejection mailed May 28, 2013 by the Japanese Patent Office in corresponding Japanese Patent Application No. 2009-500164 with partial English translation of portion enclosed within wavy lines, 3 pages.

* cited by examiner

SPEECH SYNTHESIZING APPARATUS, METHOD, AND PROGRAM

REFERENCE TO RELATED APPLICATIONS

This application is based upon and claims the benefit of the priority of Japanese patent application No. 2007-039622 filed on Feb. 20, 2007, the disclosure of which is incorporated herein in its entirety by reference thereto.

TECHNICAL FIELD

The present invention relates to speech synthesizing technology, and in particular to a speech synthesizing apparatus, method, and program for synthesizing speech from text.

BACKGROUND ART

Heretofore, there have been developed various speech synthesizing apparatuses for analyzing text and generating synthesized speech by rule-based synthesis from speech information indicated by the text.

FIG. 9 is a diagram showing a configuration of one example of a speech synthesizing apparatus of a general rule-based synthesis type. With regard to details of the configuration and operation of the speech synthesizing apparatus having this type of configuration, reference is made to descriptions of Non-Patent Documents 1 to 3 and Patent Documents 1 and 2, for example.

Referring to FIG. 9, the speech synthesizing apparatus includes a language processing unit 10, a prosody generation unit 11, a segment selection unit 16, a speech segment information storage unit 15, a prosody control unit 18, and a waveform connection unit 19.

The speech segment information storage unit 15 includes a speech segment storage unit 152 for storing an original speech waveform (referred to below as "speech segment") divided into speech synthesis units, and an associated information storage unit 151 in which attribute information of each speech segment is stored.

Here, the original speech waveform is a natural speech waveform collected in advance for use in generating synthesized speech.

The attribute information of the speech segments includes phonological information and prosody information such as phoneme context in which each speech segment is uttered; pitch frequency, amplitude, continuous time information, and the like.

In the speech synthesizing apparatus of FIG. 9, phonemes, CV, CVC, VCV (in this regard, V is a vowel and C is a consonant) and the like are often used in a speech synthesis unit. Details of length of speech segments and synthesis units are described in Non-Patent Documents 1 and 3.

The language processing unit 10 performs morphological analysis, syntax analysis, reading analysis and the like, on input text, and outputs a symbol sequence representing a "reading" of a phonemic symbol or the like, a morphological part of speech, conjugation, an accent type and the like, as language processing results, to the prosody generation unit 11 and the segment selection unit 16.

The prosody generation unit 11 generates prosody information (information on pitch, length of time, power, and the like) for the synthesized speech, based on the language processing result output from the language processing unit 10, and outputs the generated prosody information to the segment selection unit 16 and the prosody control unit 18.

The segment selection unit 16 selects speech segments having a high degree of compatibility with regard to the language processing result and the generated prosody information, from among speech segments stored in the speech segment information storage unit 15, and outputs the selected speech segment in conjunction with associated information of the selected speech segment to the prosody control unit 18.

The prosody control unit 18 generates a waveform having a prosody generated by the prosody generation unit 11, from the selected speech segments, and outputs the result to the waveform connection unit 19.

The waveform connection unit 19 connects the speech segments output from the prosody control unit 18 and outputs the result as synthesized speech.

The segment selection unit 16 obtains information (referred to as target segment environment) representing characteristics of target synthesized speech, from the input language processing result and the prosody information, for each prescribed synthesis unit.

The following may be cited as information included in the target segment environment:

respective phoneme names of phoneme in question, preceding phoneme, and subsequent phoneme, presence or absence of stress, distance from accent core, pitch frequency and power for representative point, start point, and end point of a synthesis unit, and continuous time length of unit.

Next, when the target segment environment is given, the segment selection unit 16 selects a plurality of speech segments matching specific information (mainly the phoneme in question) designated by the target segment environment, from the speech segment information storage unit 15. The selected speech segments form candidates for speech segments used in synthesis.

The segment selection unit 16, with regard to the selected candidate segments, calculates "cost" which is an index indicating suitability as speech segments used in the synthesis. Since generation of synthesized speech of high sound quality is a target, if the cost is small, that is, if the suitability is high, the sound quality of the synthesized sound is high. Therefore, the cost may be said to be an indicator for estimating deterioration of the sound quality of the synthesized speech.

The cost calculated by the segment selection unit 16 includes a unit cost and a concatenation cost.

Since the unit cost represents estimated sound quality deterioration produced by using candidate segments under the target segment environment, computation is executed based on degree of similarity of the segment environment of the candidate segments and the target segment environment.

On the other hand, since concatenation cost represents estimated sound quality deterioration level produced by a segment environment between concatenated speech segments being non-continuous, the cost is calculated based on affinity level of segment environments of adjacent candidate segments.

Various types of methods of calculation unit cost and concatenation cost have been proposed heretofore.

In general, information included in the target segment environment is used in the computation of the unit cost.

Pitch frequency, cepstrum, power, and A amount thereof (amount of change per unit time), with regard to concatenation boundary of a segment, are used in the concatenation cost.

The segment selection unit 16 calculates the concatenation cost and the unit cost for each segment, and then obtains a speech segment, for which both the concatenation cost and the unit cost are minimum, uniquely for each synthesis unit.

Since a segment obtained by cost minimization is selected as a segment most suited to speech synthesis from among the candidate segments, it is referred to as an "optimum segment".

The segment selection unit 16 obtains respective optimal segments for entire synthesis units, and finally outputs a sequence of optimal segments (optimal segment sequence) as a segment selection result to the prosody control unit 18.

In the segment selection unit 16, as described above, the speech segments having a small unit cost are selected, that is, the speech segments having a prosody close to a target prosody (prosody included in the target segment environment) are selected, but it is rare for a speech segment having a prosody equivalent to the target prosody to be selected.

Therefore, in general, after the segment selection, in the prosody control unit 18 a speech segment waveform is processed to make a correction so that the prosody of the speech segment matches the target prosody.

As a representative method of correcting the prosody of the speech segment, a PSOLA (pitch-synchronous-overlap-add) method described in Non-Patent Document 4 is cited.

However, the prosody correction processing is a cause of degradation of synthesized speech. In particular, the change in pitch frequency has a large effect on sound quality degradation, and the larger the amount of the change, the larger is the sound quality deterioration.

For coping with this type of problem, development is taking place of a method of synthesizing with as small a prosody change amount as possible. For example, as in Non-Patent Documents 5 and 6, a method has been proposed in which a huge quantity of speech segments are prepared, and no correction at all of the prosody of the speech segments is carried out.

In this type of method, since the quantity of segments is very large, with regard to a certain input text, speech segments having a sufficiently high level of similarity with the target prosody are selected, and even if the prosody is not corrected, synthesized speech having natural prosody is generated.

However, there are problems such as that it is difficult to generate synthesized speech that always has natural prosody, an extremely large storage capacity is required, and the like.

Otherwise, in Non-Patent Document 7, an approach is taken in which an upper limit value is set for the change amount of the pitch frequency, segments are recorded that have various pitch frequencies, or the like.

[Patent Document 1]

JP Patent Kokai Publication No. JP-P2005-91551A

[Patent Document 2]

JP Patent Kokai Publication No. JP-P2006-84854A

[Non-Patent Document 1]

Huang, Acero, Hon: "Spoken Language Processing", Prentice Hall, pp. 689-836, 2001.

[Non-Patent Document 2]

Ishikawa: "Prosodic Control for Japanese Text-to-Speech Synthesis", The Institute of Electronics, Information and Communication Engineers, Technical Report, Vol. 100, No. 392, pp. 27-34, 2000.

[Non-Patent Document 3]

Abe: "An introduction to speech synthesis units", The Institute of Electronics, Information and Communication Engineers, Technical Report, Vol. 100, No. 392, pp. 35-42, 2000.

[Non-Patent Document 4]

Moulines, Charapentier: "Pitch-Synchronous Waveform Processing Techniques For Text-To-Speech Synthesis Using Diphones", Speech Communication 9, pp. 453-467, 1990.

[Non-Patent Document 5]

Segi, Takagi, Ito: "A CONCATENATIVE SPEECH SYNTHESIS METHOD USING CONTEXT DEPENDENT PHONEME SEQUENCES WITH VARIABLE LENGTH AS SEARCH UNITS", Proceedings of 5th ISCA Speech Synthesis Workshop, pp. 115-120, 2004.

[Non-Patent Document 6]

Kawai, Toda, Ni, Tsuzaki, Tokuda: "XIMERA: A NEW TTS FROM AIR BASED ON CORPUS-BASED TECHNOLOGIES", Proceedings of 5th ISCA Speech Synthesis Workshop, pp. 179-184, 2004.

[Non-Patent Document 7]

Koyama, Yoshioka, Takahashi, Nakamura: "High Quality Speech Synthesis Using Reconfigurable VCV Waveform Segments with Smaller Pitch Modification", Transactions of the Institute of Electronics, Information and Communication Engineers, D-II, Vol. 183-D-II, No. 11, pp. 2264-2275, 2000.

SUMMARY

The entire disclosures of the abovementioned Patent Documents 1 and 2, and Non-Patent Documents 1 to 7 are incorporated herein by reference thereto. The following analysis is given for technology related to the present vention.

A speech synthesizing apparatus described in the abovementioned Non-Patent Document 7 and the like has problems as described below.

Sound quality of synthesized speech is apt to become non-uniform.

By performing prosody control, as in Non-Patent Document 7, in a method aiming to improve naturalness of prosody of synthesized speech, in order to reduce sound quality deterioration accompanying prosody control, a policy has been taken in which a speech segment having prosody with a high degree of similarity to a target prosody, that is, a speech segment whose prosody change amount is small, is selected. As a result, there occurs such a state in which, within the same text (within an optimal segment sequence), the prosody of a certain speech segment has a high degree of similarity with a target prosody, and the prosody of another speech segment has a low degree of similarity with the target prosody, that is, speech segments having different prosody levels of similarity are mixed.

With regard to this state a description is given using FIGS. 10A-10C, limiting prosody information to a basic frequency. In order to describe the abovementioned problems, FIGS. 10A-10C show what the inventers of the present invention have created.

FIG. 10A is a diagram showing an example of pitch pattern (general form of a basic frequency) of candidate segments and target segment environment. In FIG. 10A, a thick solid line represents a target pitch pattern, thin solid lines u1 to u7 represent pitch patterns of respective candidate segments, and T1 to T5 represent boundary time instants of synthesis units.

In the related art, in each synthesis unit interval, candidate segments closest to the target pitch pattern, u1, u2, u3, u4, and u5 in the example of FIG. 10A are selected as an optimum segment sequence.

FIG. 10B shows prosody change amount (here, change amount of a basic frequency) when u1 to u5 are selected, for each respective synthesis unit interval.

Since differences between the target pitch pattern and the candidate segment pitch patterns form the prosody change amounts, a situation as in FIG. 10B occurs. As shown in FIG. 10B, it is understood that prosody change amounts from T0 through to T5 are irregular.

When the prosody change amounts in the same sentence in this way are irregular, a sense of non-uniformity of sound quality of the synthesized speech (a certain portion has high sound quality, and another portion has low sound quality) is brought about.

This non-uniformity of sound quality is a cause of a worsening of the overall impression of synthesized speech. In particular, if the non-uniformity of sound quality is large, the impression of the synthesized speech is worse than for a case of low sound quality in which the sound quality is always equal.

Therefore, the present invention has been made in consideration of the abovementioned problems, and it is a principal object of the invention to provide a apparatus, method, and program for eliminating the non-uniformity of sound quality in synthesized speech.

In accordance with a first aspect of the present invention, there is provided a speech synthesizing apparatus that includes a segment selection unit for selecting a segment suited to a target segment environment from among candidate segments, wherein the segment selection unit excludes, from a target of the selection, a segment having a prosody change amount whose magnitude relationship with a selection criterion determined based on a prosody change amount of the candidate segments is a predetermined prescribed relationship. In the present invention, the segment selection unit is provided with a prosody change amount calculation unit that calculates a prosody change amount of each candidate segment, based on prosody information of the target segment environment and the candidate segments, a selection criterion calculation unit that'calculates a selection criterion, based on the prosody change amount, a candidate selection unit that narrows down selection candidates, based on the prosody change amount and the selection criterion, and an optimum segment search unit that searches for an optimum segment from among the narrowed-down candidate segments.

According to the abovementioned first aspect of the invention, by calculating the prosody change amount of the candidate segments, and, based on the selection criterion obtained from the prosody change amount in question, excluding, from the candidates, speech segments for which the magnitude relationship between the selection criterion and the prosody change amount is a predetermined prescribed relationship (for example, the prosody change amount is particularly small, comparatively), the variance of the prosody change amount of a speech segment, for which the possibility of being selected is high, is decreased. As a result, since the prosody change amount is made uniform, level of deterioration of sound quality due to prosody control is made uniform, and it is possible to eliminate a sense of non-uniformity of the sound quality.

In accordance with a second aspect of the present invention, there is provided a speech synthesizing apparatus that includes a segment selection unit for selecting a segment suited to a target segment environment from among candidate segments, wherein the segment selection unit includes: an optimum segment search unit that searches for an optimum segment, based on the target segment environment and a segment environment of the candidate segments, a prosody change amount calculation unit that calculates a prosody change amount of each candidate segment, based on prosody information of the target segment environment and the candidate segments, a selection criterion calculation unit that calculates a selection criterion based on the prosody change amount, and a decision unit that decides, in a case where, among the optimum segments, there exists a segment having a prosody change amount whose magnitude relationship with the selection criterion is a predetermined prescribed relationship, that re-execution of search for an optimum segment is necessary, and wherein, in a case where the decision unit decides that the re-execution of the search for an optimum segment is necessary, the optimum segment search unit re-executes the search for the optimum segment.

In the present invention, the prosody change amount calculation unit calculates the prosody change amount for only an optimum segment.

In the present invention, the optimum segment search unit excludes segments that do not satisfy the selection criterion from candidates, and re-executes searching for the optimum segment.

In accordance with a third aspect of the present invention, there is provided a speech synthesizing apparatus that includes a segment selection unit for selecting a segment suited to a target segment environment from among candidate segments, wherein the segment selection unit includes: a prosody change amount calculation unit that calculates a prosody change amount of each candidate segment, based on prosody information of the target segment environment and the candidate segments, a selection criterion calculation unit that calculates a selection criterion from the prosody change amount, a unit cost calculation unit that calculates a unit cost of each candidate segment based on the target segment environment and a segment environment of the candidate segments, and an optimum segment search unit that searches for an optimum segment from among candidate segments based on the unit cost, and wherein the unit cost calculation unit assigns a penalty to a unit cost of a segment having a prosody change amount whose magnitude relationship with the selection criterion is a predetermined prescribed relationship.

In the present invention, the unit cost calculation unit determines the penalty according to a relative relationship of the prosody change amount and the selection criterion.

In the present invention, the selection criterion calculation unit determines the selection criterion based on an average value of the prosody change amount.

In the present invention, the selection criterion calculation unit determines the selection criterion based on a value obtained by smoothing the prosody change amount in a time domain.

According to the present invention, there is provided a speech synthesizing method that includes a step of selecting a segment suited to a target segment environment from among candidate segments, wherein the step of selecting the segment excludes, from a selection target, a segment having a prosody change amount whose magnitude relationship with a selection criterion determined based on a prosody change amount of the candidate segments is a predetermined prescribed relationship.

According to another aspect of the present invention, there is provided a speech synthesizing method that includes a step of selecting a segment suited to a target segment environment from among candidate segments, wherein the step of selecting the segment includes: a step of calculating a prosody change amount of each candidate segment, based on prosody information of the target segment environment and the candidate segments, a step of calculating a selection criterion based on the prosody change amount, a step of narrowing down selection candidates, based on the prosody change amount and the selection criterion, and a step of searching for an optimum segment from among the narrowed-down candidate segments, and wherein the step of narrowing down the candidate selection excludes, from a target of search for the optimum segment, a segment having a prosody change amount whose magnitude relationship with the selection criterion is a predetermined prescribed relationship.

In the present invention, the step of calculating the selection criterion, includes a step of calculating cost of each candidate segment based on the target segment environment and the segment environment of the candidate segments, and the selection criterion is calculated based on the cost.

According to another aspect of the present invention, there is provided a speech synthesizing method having a segment selection unit for selecting a segment suited to a target segment environment from among candidate segments, wherein the step of selecting the segment includes:

a step of searching for an optimum segment, based on the target segment environment and a segment environment of the candidate segments, a step of calculating a prosody change amount of each candidate segment, based on prosody information of the target segment environment and the candidate segments, a step of calculating a selection criterion based on the prosody change amount, and a step of deciding, in a case where, among the optimum segments, there exists a segment having a prosody change amount whose magnitude relationship with the selection criterion is predetermined prescribed relationship, that re-execution of search for an optimum segment is necessary, and wherein, in a case where the step of deciding judges that the re-execution of the search for an optimum segment is necessary, the step of searching for the optimum segment re-executes the search for optimum segment.

In the present invention, a step of calculating the prosody change amount includes: calculating the prosody change amount for only an optimum segment. In the present invention, the step of searching for the optimum segment includes excluding segments that do not satisfy the selection criterion from candidates, and re-executing the search for the optimum segment.

According to another aspect of the present invention, there is provided a speech synthesizing method that includes a step of selecting a segment suited to a target segment environment from among candidate segments, wherein the step of selecting the segment includes: a step of calculating a prosody change amount of each candidate segment, based on prosody information of the target segment environment and the candidate segments, a step of calculating a selection criterion from the prosody change amount, a step of calculating a unit cost of each candidate segment based on the target segment environment and a segment environment of the candidate segments, and a step of searching for an optimum segment from among the candidate segments based on the unit cost, and wherein the step of calculating the unit cost assigns a penalty to a unit cost of a segment having a prosody change amount whose magnitude relationship with the selection criterion is a predetermined prescribed relationship.

In the present invention, the step of calculating the unit cost determines the penalty according to a relative relationship of the prosody change amount and the selection criterion.

In the present invention, the step of calculating the selection criterion determines the selection criterion based on an average value of the prosody change amount.

In the present invention, the step of calculating the selection criterion determines the selection criterion based on a value obtained by smoothing the prosody change amount in a time domain.

According to another aspect of the present invention, there is provided a program for causing a computer, which constitutes a speech synthesizing apparatus, to execute a processing of selecting a segment suited to a target segment environment from among candidate segments, wherein the processing of selecting the segment includes excluding, from a selection target, a segment having a prosody change amount whose magnitude relationship with a selection criterion determined based on a prosody change amount of the candidate segments is a predetermined prescribed relationship.

According to another aspect of the present invention, there is provided a program for causing a computer, which constitutes a speech synthesizing apparatus, to execute a processing of selecting a segment suited to a target segment environment from among candidate segments, wherein the processing of selecting the segment includes:

a processing of calculating a prosody change amount of each candidate segment, based on prosody information of the target segment environment and the candidate segments, a processing of calculating a selection criterion based on the prosody change amount, a processing of narrowing down the selection candidates, based on the prosody change amount and the selection criterion, and a processing of searching for an optimum segment from among the narrowed-down candidate segments, and wherein the processing of narrowing down the selection candidates includes a processing of excluding, from a target of search for the optimum segment, a segment having a prosody change amount whose magnitude relationship with the selection criterion is a predetermined prescribed relationship.

In the computer program according to the present invention, the processing of calculating the selection criterion includes a processing of calculating cost of each candidate segment based on the target segment environment and the segment environment of candidate segments, and includes a processing of calculating the selection criterion based on the cost.

According to another aspect of the present invention, there is provided a program for causing a computer, which constitutes a speech synthesizing apparatus, to execute a processing of selecting a segment suited to a target segment environment from among candidate segments, wherein the processing of selecting the segment includes:

a processing of searching for an optimum segment, based on the target segment environment and a segment environment of the candidate segments, a processing of calculating a prosody change amount of each candidate segment, based on prosody information of the target segment environment and the candidate segments, a processing of calculating a selection criterion based on the prosody change amount, and a processing of deciding, in a case where, among the optimum segments, there exists a segment having a prosody change amount whose magnitude relationship with the selection criterion is a predetermined prescribed relationship, that re-execution of search for the optimum segment is necessary, and wherein the processing of deciding includes a process in which, in a case where it is decided that the re-execution of the search for an optimum segment is necessary, the processing of searching for the optimum segment re-executes the search for the optimum segment.

In the computer program according to the present invention, the processing of calculating the prosody change amount includes a processing of calculating the prosody change amount for only the optimum segments.

In the computer program according to the present invention, the processing of searching for the optimum segment includes a processing of excluding segments that do not satisfy the selection criterion from candidates, and re-executing search for the optimum segment.

According to another aspect of the present invention, there is provided a program for causing a computer, which constitutes a speech synthesizing apparatus, to execute a processing of selecting a segment suited to a target segment environment from among candidate segments, wherein the processing of selecting the segment includes:

a processing of calculating a prosody change amount of each candidate segment, based on prosody information of the target segment environment and the candidate segments, a processing of calculating a selection criterion from the prosody change amount, a processing of calculating a unit cost of each candidate segment based on the target segment environment and a segment environment of the candidate segments, and a processing of searching for an optimum segment from among candidate segments based on the unit cost, and wherein the processing of calculating the unit cost includes a processing of assigning a penalty to a unit cost of a segment having a prosody change amount whose magnitude relationship with the selection criterion is a predetermined prescribed relationship.

In the computer program according to the present invention, the processing of calculating the unit cost includes a processing of determining the penalty according to a relative relationship of the prosody change amount and the selection criterion.

In the computer program according to the present invention, the processing of calculating the selection criterion includes a processing of determining the selection criterion based on an average value of the prosody change amount.

In the computer program according to the present invention, the processing of calculating the selection criterion includes a processing of determining the selection criterion based on a value obtained by smoothing the prosody change amount in a time domain.

According to the present invention, in a segment selection unit, since speech segments are selected in order that the prosody change amount is uniform, sound quality deterioration due to prosody control is made uniform, and a sense of non-uniformity of sound quality is eliminated.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

Figure 10A:
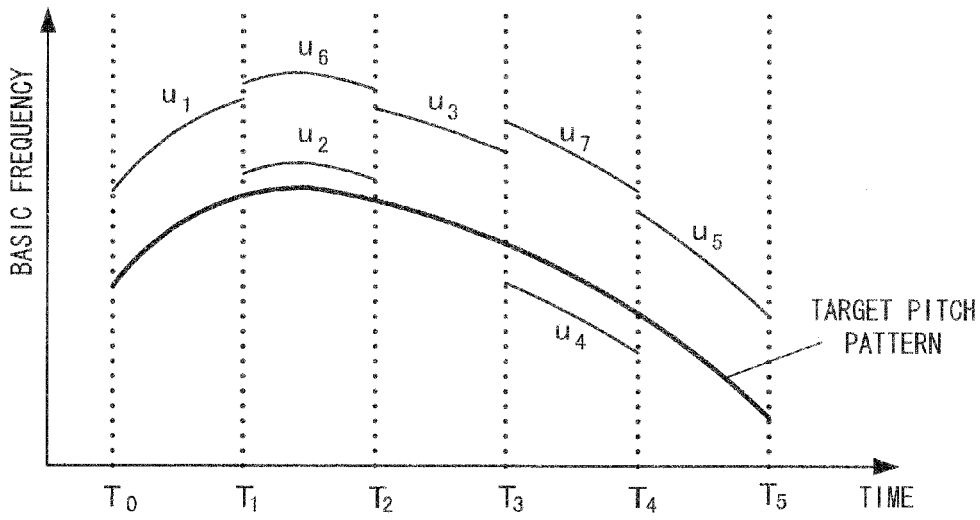
FIGS. 10A-10C are diagrams for describing problem points of related technology and solution proposals.
Figure 10B:
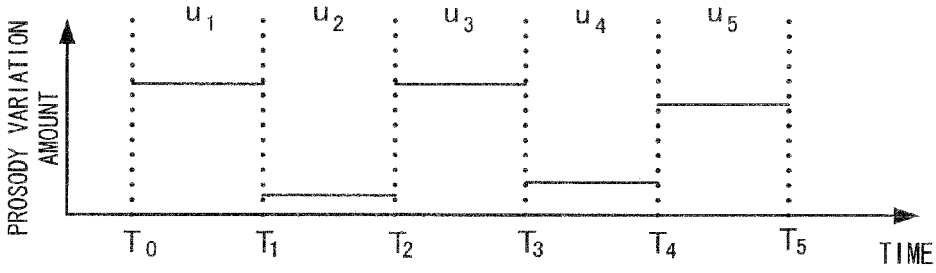
Figure 10C:
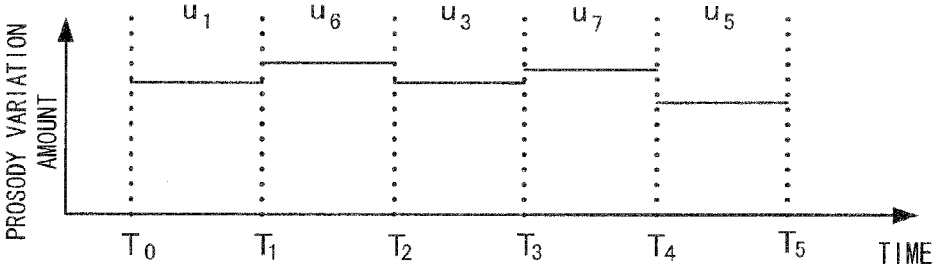

The principle of the present invention will be described. In the present invention, selection of speech segments is performed in order that prosody change amount is uniform. That is, the prosody change amount of candidate segments is calculated, and based on a selection criterion obtained from the prosody change amount, by excluding speech segments having a relatively particularly small prosody change amount, from the candidates, the variance of the prosody change amount of the speech segments, which have a high possibility of being selected, is decreased. Thus, the prosody change amount is made uniform, sound quality deterioration level due to prosody control is made uniform, and it is possible to eliminate a sense of non-uniformity of the sound quality. For example, in a case of applying the present invention to an example shown in FIG. 10A, in an interval T1 to T2, u6 is selected instead of u2, and in an interval T3 to T4, u7 is selected instead of u4, so that the prosody change amount is made uniform, as shown in FIG. 10C. The present invention is described below in accordance with exemplary embodiments.

<Exemplary Embodiment 1>

Figure 1:
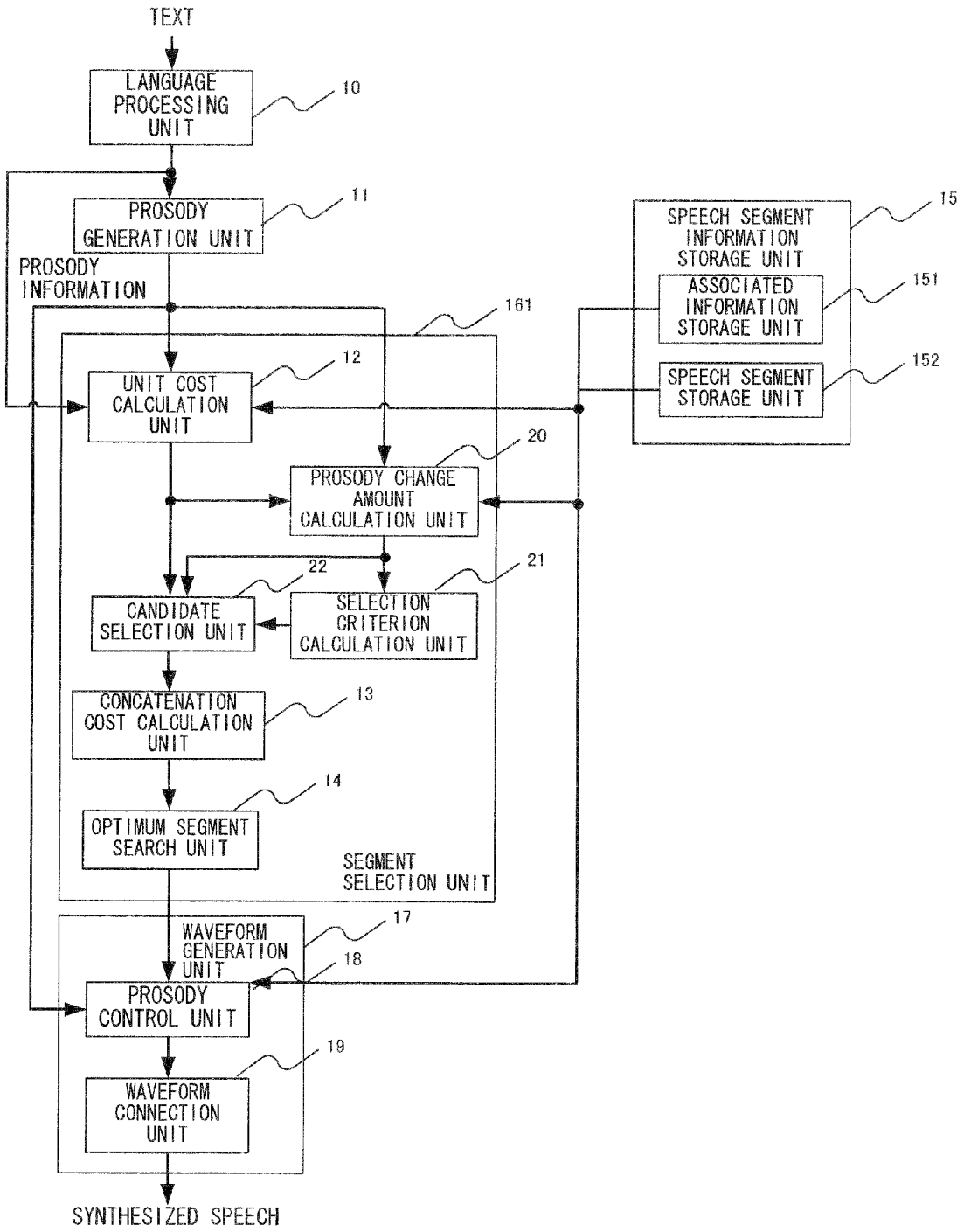
FIG. 1 is a diagram showing a configuration of a first exemplary embodiment of the present invention.
Figure 2:
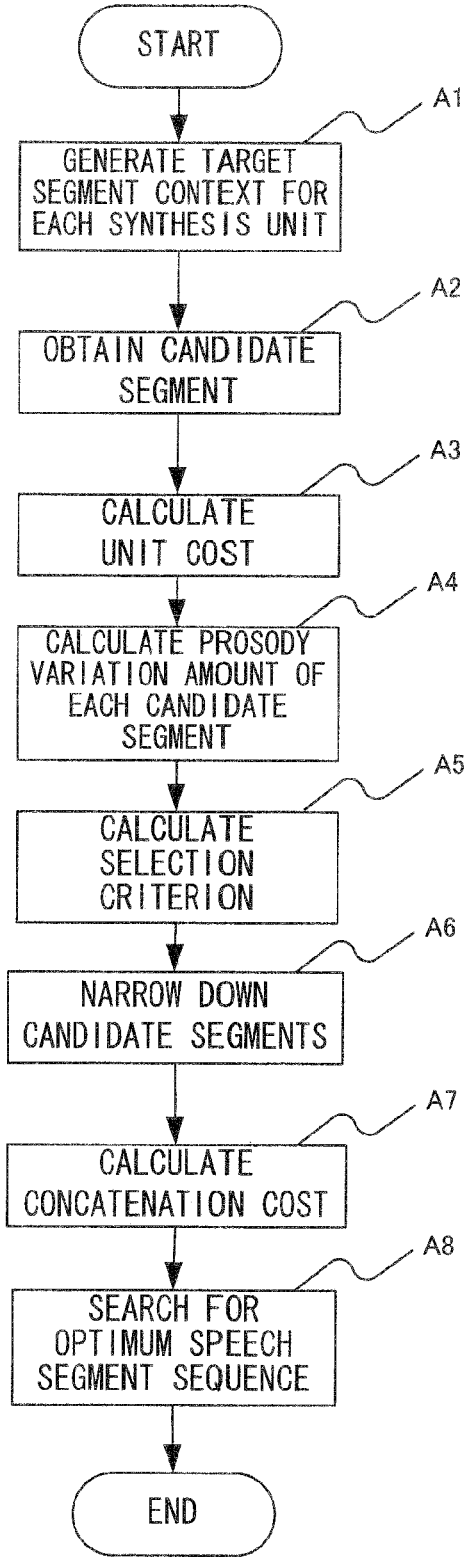
FIG. 2 is a flowchart for describing operation of the first exemplary embodiment of the present invention.

FIG. 1 is a diagram showing a configuration of a first exemplary embodiment of the present invention. FIG. 2 is a flowchart for describing operation of the first exemplary embodiment of the present invention.

Figure 9:
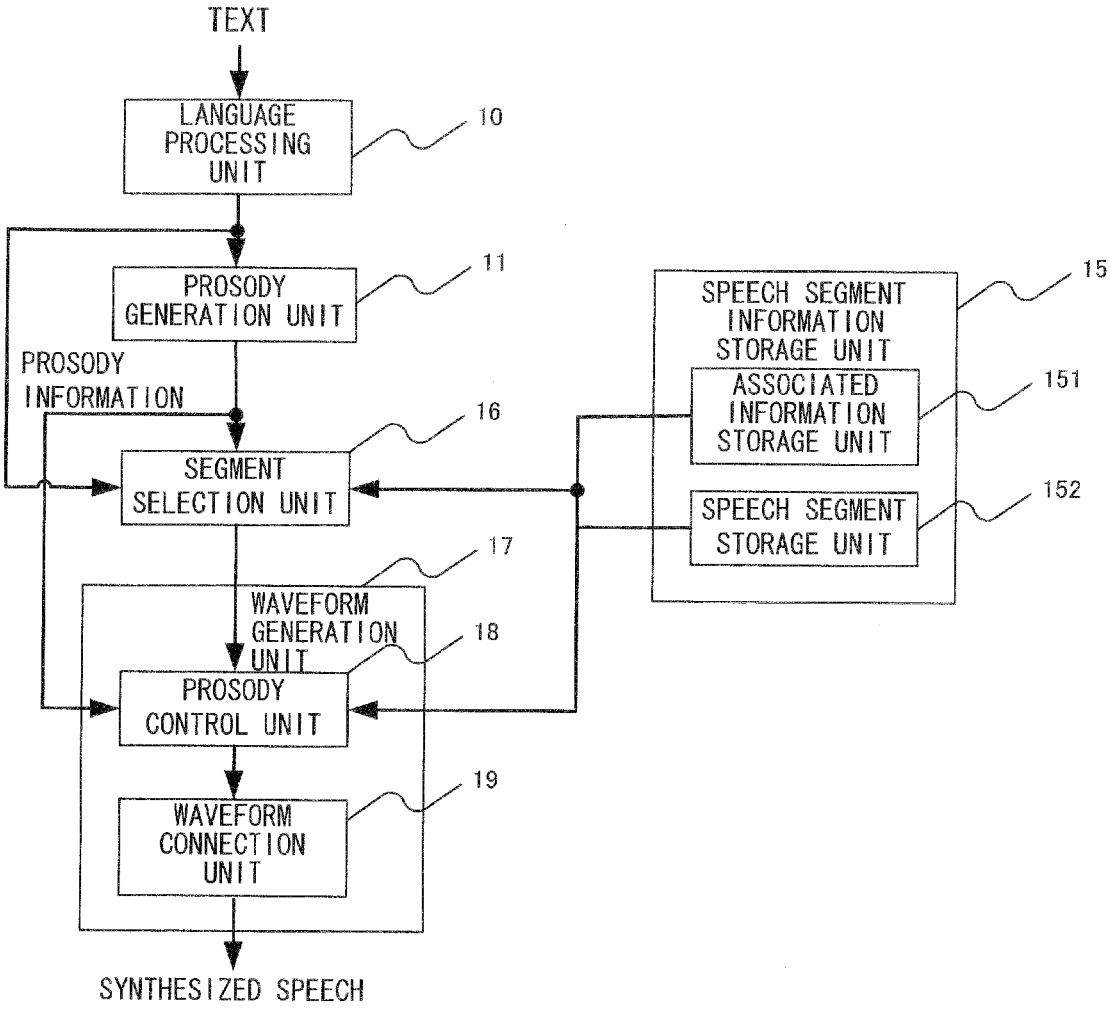
FIG. 9 RELATED ART
FIG. 9 is a block diagram showing one configuration example of a general speech synthesizing apparatus.

Referring to FIG. 1, the first exemplary embodiment of the present invention differs from FIG. 9, which shows a configuration of the related art, with respect to a segment selection unit. That is, the segment selection unit 16 of FIG. 9 is replaced by the segment selection unit 161 of FIG. 1. In the first exemplary embodiment of the present invention, the configuration otherwise is the same as FIG. 9. Below, the description is centered on points of difference, and in order to avoid duplication, descriptions of similar portions are omitted as appropriate.

Referring to FIG. 1, in the present exemplary embodiment, the segment selection unit 161 has a unit cost calculation unit 12, a concatenation cost calculation unit 13, an optimum segment search unit 14, a prosody change amount calculation unit 20, a selection criterion calculation unit 21, and a candidate selection unit 22.

The unit cost calculation unit 12 generates a target segment environment from a language processing result supplied by a language processing unit 10, and prosody information supplied by a prosody generation unit 11, for each synthesis unit (step A1 in FIG. 2).

In the present exemplary embodiment, it is supposed that the target segment environment is composed of:

respective phoneme names of phoneme in question, preceding phoneme, and subsequent phoneme, distance from accent core, pitch frequency and power for a representative point of synthesis unit, and continuous time length of unit.

Next, the unit cost calculation unit 12 selects, as candidate segments, a plurality of speech segments that match specific information designated by the target segment environment from a speech segment information storage unit 15 (step A2 in FIG. 2). With regard to information used when selecting a candidate segment, the segment in question is representative, but a method of narrowing down candidates using information related to the preceding phoneme and the subsequent phoneme is also effective.

The unit cost calculation unit 12 calculates a unit cost of each candidate segment, based on the target segment environment and a segment environment of the candidate segment supplied by the speech segment information storage unit 15, and outputs to the prosody change amount calculation unit 20 and the candidate selection unit 22 (step A3).

The prosody change amount calculation unit 20 calculates the prosody change amount of each candidate segment, based on the prosody information supplied by the prosody generation unit 11, the unit cost of each candidate segment supplied by the unit cost calculation unit 12, and attribute information of each candidate segment supplied by the speech segment information storage unit 15, and transmits this to the selection criterion calculation unit 21 and the candidate selection unit 22 (step A4).

The prosody change amount is defined as the change amount of the prosody of a speech segment in the prosody control unit 18. In actuality, the prosody change amount is calculated based on pitch frequency, continuous time length, and power change amount.

Since change in power has little effect on sound quality, in the present exemplary embodiment, power change amount is not dealt. However, it is possible to deal with power change amount in the same way as the pitch frequency or the continuous time length.

If the change amount of the pitch frequency is $\Delta f$, and change amount of the continuous time length is $\Delta t$, the prosody change amount $\Delta p$ is defined by the weighted sum of Expression (1) as described below.

$$\Delta p=\alpha\Delta f+\beta\Delta t \tag{1}$$

In this regard, $\alpha$ and $\beta$ are weighted coefficients.

Since the pitch frequency has a larger effect on the sound quality, $\alpha>\beta$ in many cases.

In Expression (1), the change amount of the pitch frequency, the continuous time length, and the like are effective when defined by difference.

In addition to this, a method is also effective using Expression (2) described below, of a weighted addition of logarithms of $\Delta f$ and $\Delta t$.

$$\Delta p=\alpha\log(\Delta f)+\beta\log(\Delta t) \tag{2}$$

Expression (2) is particularly effective in a case where the change amount of the pitch frequency or the like is defined not by difference but by ratio.

Calculation of the change amount of the continuous time length is based on a ratio or difference of time length before and after a change.

If continuous time lengths before a change and after a change are respectively t and T, the change amount of the continuous time length, when calculated based on a ratio, is defined by the following Expression (3) or (4).

$$\Delta t=\frac{t}{T} \tag{3}$$

$$\Delta t=\left|\log\left(\frac{t}{T}\right)\right| \tag{4}$$

When differences of t and T are used, $\Delta t$ is defined, for example, as a distance space in the following Expression (5) or (6).

$$\Delta t=(t-T)^2 \tag{5}$$

$$\Delta t=|t-T| \tag{6}$$

The change amount of the pitch frequency, similarly to the continuous time length, is calculated based on a ratio or difference of the pitch frequency before and after a change.

However, unlike the case of the continuous time length, since pitch frequency values at, for example, the 3 points of: a start point, a midpoint, and an end point of each unit are often different, calculation using values of a plurality of locations enables calculation of change amount of the pitch frequency with better accuracy.

When the change amount of the pitch frequency is calculated using the pitch frequency at N points, the change amount $\Delta f$ of the pitch frequency is given by the following Expression (7) or (8).

$$\Delta f=\prod_{k=0}^{N-1}\frac{f_k}{F_k} \tag{7}$$

$$\Delta f=\sum_{k=0}^{N-1}w_k(f_k-F_k)^2 \tag{8}$$

In this regard, $f_k$ and $F_k$ respectively represent the pitch frequency before a change and after a change, and $W_k$ represents a weighting coefficient.

Expression (7) and Expression (8) are definitions when ratio and difference, respectively, are used in the change amount.

In Expression (7), a value that is a product of the ratio ($f_k/P_k$) from k=0 to N−1 is $\Delta f$. When calculation is performed based on the ratio, a logarithm may be used. That is, in Expression (7), $f_k/F_k$ may be replaced by log ($f_k/F_k$).

Where a start point, a midpoint, and an end point are used, N=3.

The larger N is, the more accurately the change amount of the pitch frequency can be calculated, but the calculation amount necessary for calculating the change amount becomes large.

If a slope of the pitch frequency at each point is used, it is possible to calculate the prosody change amount with high accuracy and with small calculation amount in comparison to when the value of N is simply made large.

The prosody change amount given by the above definitions can be approximated by an intermediate value obtained when unit cost is calculated. When it is desired to reduce calculation amount even at the cost of the approximation accuracy, a method of substituting unit cost or an intermediate value thereof, without calculating the prosody change amount, is effective.

In the selection criterion calculation unit 21, the selection criterion is calculated using a prosody change amount of a candidate segment that has a high possibility of ultimately being selected as an optimum segment, that is, whose unit cost is low.

Therefore, in the prosody change amount calculation unit 20, if the prosody change amount only for candidate segments with a low unit cost is calculated, it is possible to reduce the calculation amount for prosody change amount more than when all candidate segments are targeted.

The selection criterion calculation unit 21 computes the candidate selection criterion necessary for narrowing down the candidate segments, based on the prosody change amount of each candidate segment supplied by the prosody change amount calculation unit 20, to be supplied to the candidate selection unit 22 (step A5).

A principal object of the candidate selection unit 22 is to exclude from candidate segments whose prosody change amount is particularly small as compared to others, among candidate segments having a high possibility of being ultimately selected as an optimum segment (referred to as "optimum speech segment").

Therefore, basically, the prosody change amount of good candidate segments (segments whose unit cost is low) in each synthesis unit are analyzed as principal targets of analysis, and the selection criterion is calculated, The selection criterion value may be a value that is common to all the synthesis units, or a value that is calculated sequentially for each synthesis unit. Furthermore, a case is also possible where the value is common in a specific range of an accent phrase or breath group.

A basic calculation procedure for the selection criterion is as follows.

First, for each synthesis unit, an analysis target is selected and a representative value obtained.

Next, using the representative value of each synthesis unit, a criterion value is calculated.

A method of obtaining a representative value without selecting an analysis target, and a method of calculating the criterion value without obtaining a representative value are also effective.

Further detailed descriptions of each of: selection of the analysis target, calculation of the representative value, and calculation of a selection criterion value, used in the present exemplary embodiment are described.

<Selection of Analysis Target>

There exist a plurality of methods of selecting a prosody change amount target used when calculating the selection criterion value, that is, methods of selecting the analysis target.

A simplest and most effective method is a method of having as an analysis target the prosody change amount of the best candidate segment (a segment whose unit cost is lowest) of each synthesis unit.

In such a case, since there is one analysis target for each synthesis unit, this method is also a method of obtaining a representative value at the same time.

In a case where a plurality of analysis targets are provided for each synthesis unit.

a method of selecting analysis targets, with unit cost as a reference, that is, a method having, as an analysis target, the prosody change amount of candidate segments whose unit cost is less than a prescribed value, or a method of having, as an analysis target, N segments from those with lowest unit cost (good N segments) in each synthesis unit, are effective.

As a matter of course, the prosody change amount of all candidate segments may be the analysis target.

<Calculation of Representative Value>

In the same way, there exist a plurality of methods of obtaining representative values of each synthesis unit necessary in calculating the selection criterion.

Most often used representative value is a statistical value such as:

average value, median value, best value, and the like.

Rather than calculating the representative value directly, from the analysis target, a method of calculating the representative value by an analysis target weighted by weightings determined in accordance with the unit cost is also effective. That is, by assigning a large weighting to the prosody change amount of segments whose unit cost is low, in calculating the selection criterion, the effect of segments whose unit cost is low is made large. The weighting in accordance with the unit cost is an effective method, not only for the representative value, but also in calculating the selection criterion from a plurality of analysis targets.

<Calculation of Selection Criterion Value>

As representative calculation methods of the selection criterion value, a method of calculating an average value, and a method of smoothing in a time domain, may be cited.

In a case where an average value is used, basically an average value of the representative value of each synthesis unit is calculated as the selection criterion.

When a common selection criterion in all the synthesis units is to be obtained, calculation is done using the representative value of all the synthesis units, and when a selection criterion is to be obtained for each accent phrase, calculation is done using the representative value of synthesis units composing each accent phrase.

Furthermore, a method of calculating an average value of all analysis targets, rather than a representative value, is also possible.

When smoothing is used, basically a selection criterion is calculated for each synthesis unit. Since a value smoothed in a time domain is calculated, in a case where there exist a plurality of analysis targets for each synthesis unit, a method of first obtaining a representative value of each synthesis unit, and of smoothing the representative value in a time domain, is used.

As a representative smoothing method, a moving average, first order leaky integration or the like, may be cited.

Here, in an interval (accent phrase, breath group, or the like) composed of K synthesis units, with a representative value (for example, a prosody change amount of a best candidate segment) of an i-th synthesis unit as $\Delta q(i)$, in a case where a selection criterion is supposed to be obtained by smoothing by first order leaky integration, a selection criterion L(i) of the i-th synthesis unit is given by the next Expression (9).

$$L(i)=(1-\gamma)L(i-1)+\gamma\Delta q(i),\ i=0,1,\ldots,K-1 \tag{9}$$

where, $\gamma$ is a time constant satisfying $0<\gamma<1$, and $L(-1)=0$.

The candidate selection unit 22 narrows down the candidate segments, based on the selection criterion value supplied by the selection criterion calculation unit 21, the prosody change amount of the candidate segments supplied by the prosody change amount calculation unit 20, respective candidate segment information supplied 950 by the unit cost calculation unit 12, and unit costs thereof, and transmits information of the re-selected candidate segments and the unit costs thereof to the concatenation cost calculation unit 13 (step A6).

Basically, in the candidate selection unit 22, based on the selection criterion, from among candidate segments whose unit cost is low, segments whose prosody change amount is small in comparison to others are excluded from optimum segment candidates.

A very simple method is a method of having segments whose prosody change amount is much less than the selection criterion as exclusion targets.

That is, in an i-th synthesis unit, assuming that the selection criterion is L(i), and the prosody change amount of a j-th candidate segment is Δp(i,j), if a value η obtained by the following Expression (10) or (11) is less than a threshold θ, the segment is excluded from the selection candidates.

$$\eta = W_1(\Delta p(i, j) - L(i)) \tag{10}$$

$$\eta = \begin{cases} W_2 \dfrac{\Delta p(i, j)}{L(i)}, & \Delta p(i, j) > 1.0 \\ W_2 \dfrac{L(i)}{\Delta p(i, j)}, & \Delta p(i, j) \leq 1.0 \end{cases} \tag{11}$$

where $W_1$ and $W_2$ are constants (positive real numbers).

In a case where the prosody change amount Δp(i,j) is defined based on difference, Expression (10) is effective, and in a case when defined based on ratio, Expression (11) is effective.

Otherwise, a method of calculating η based on a ratio of the selection criterion and the prosody change amount is also effective.

The concatenation cost calculation unit 13 calculates the concatenation cost of each candidate segment based on candidate segment information supplied by the candidate selection unit 22 and attribute information of each speech segment supplied by the speech segment information storage unit 15, and transmits unit cost and concatenation cost of each candidate segment to the optimum segment search unit 14 (step A7).

The concatenation cost calculation unit 13 is supplied with the unit cost of each segment from the candidate selection unit 22, together with the candidate segment information. But, The concatenation cost calculation unit 13 does not use the unit cost of each segment in the calculation of the concatenation cost.

The optimum segment search unit 14 obtains a speech segment sequence (optimum segment sequence) for which a weighted sum of the unit cost and the concatenation cost is smallest, based on candidate segment information supplied from the concatenation cost calculation unit 13, the unit cost, and the concatenation cost, and transmits the result to the prosody control unit 18 (step A8).

The optimum segment sequence may be searched for by calculating a weighted sum of the unit cost and the concatenation cost, for combinations of all the speech segments. It is also possible to make the search efficient by using dynamic programming.

In the present exemplary embodiment, in a case in which the selection criterion is determined in advance, in the candidate selection unit 22, or in a case of the selection criterion being input from outside the speech synthesizing apparatus, that is, a case where calculation from the prosody change amount is unnecessary, the selection criterion calculation unit 21 is unnecessary. In this case, it is possible to reduce the calculation amount necessary for calculating the selection criterion.

According to the speech synthesizing apparatus of the present exemplary embodiment, the prosody change amount of candidate segments is calculated, and, based on a selection criterion obtained from this prosody change amount, by excluding speech segments having a particularly small prosody change amount, relatively, from the candidates, the variance of the prosody change amount of the speech segments, for which the possibility of being selected is high, is decreased.

As a result, since the prosody change amount is made uniform, level of deterioration of sound quality due to prosody control is made uniform, and it is possible to eliminate a sense of non-uniformity of the sound quality.

<Exemplary Embodiment 2>

Figure 3:
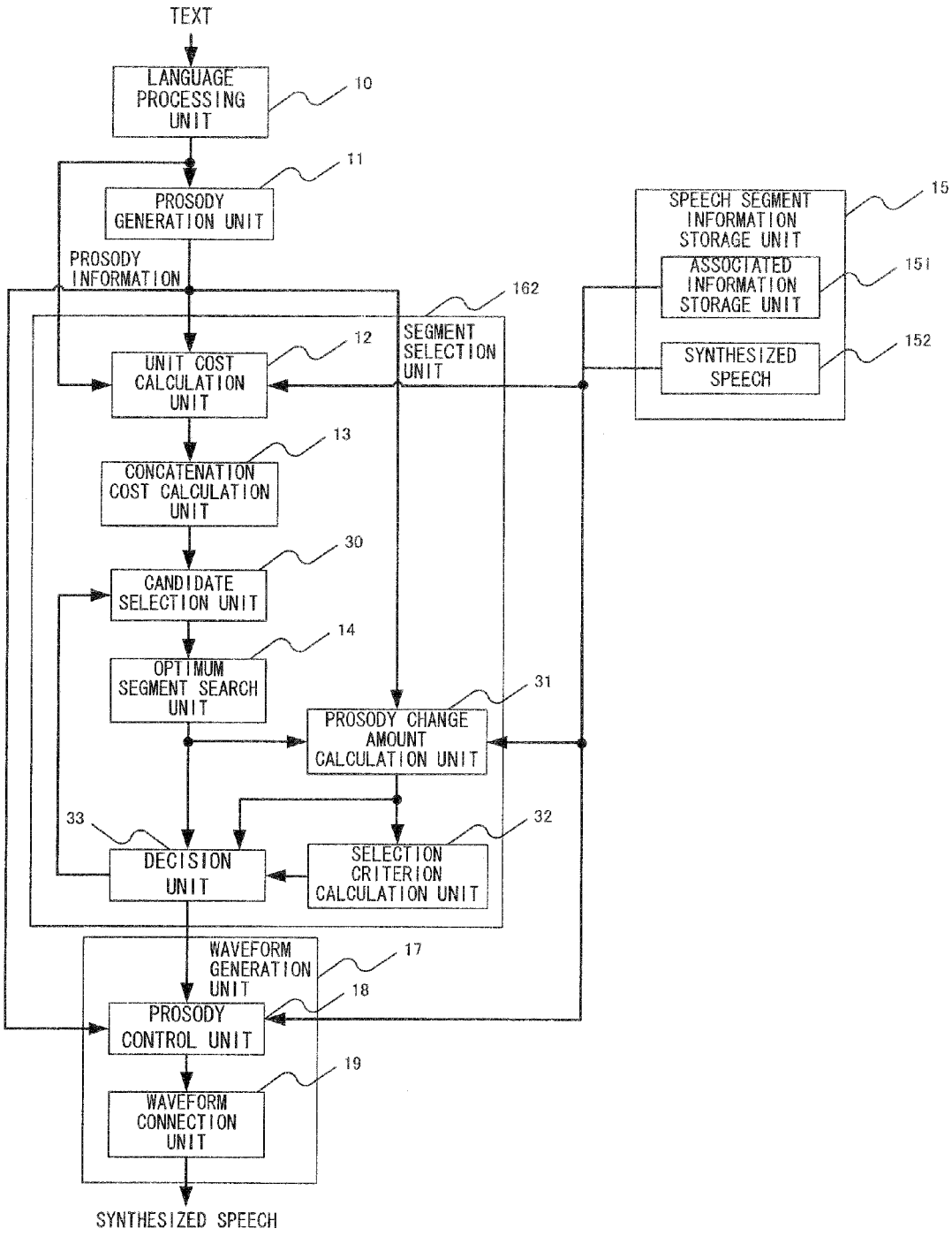
FIG. 3 is a diagram showing a configuration of a second exemplary embodiment of the present invention.
Figure 4:
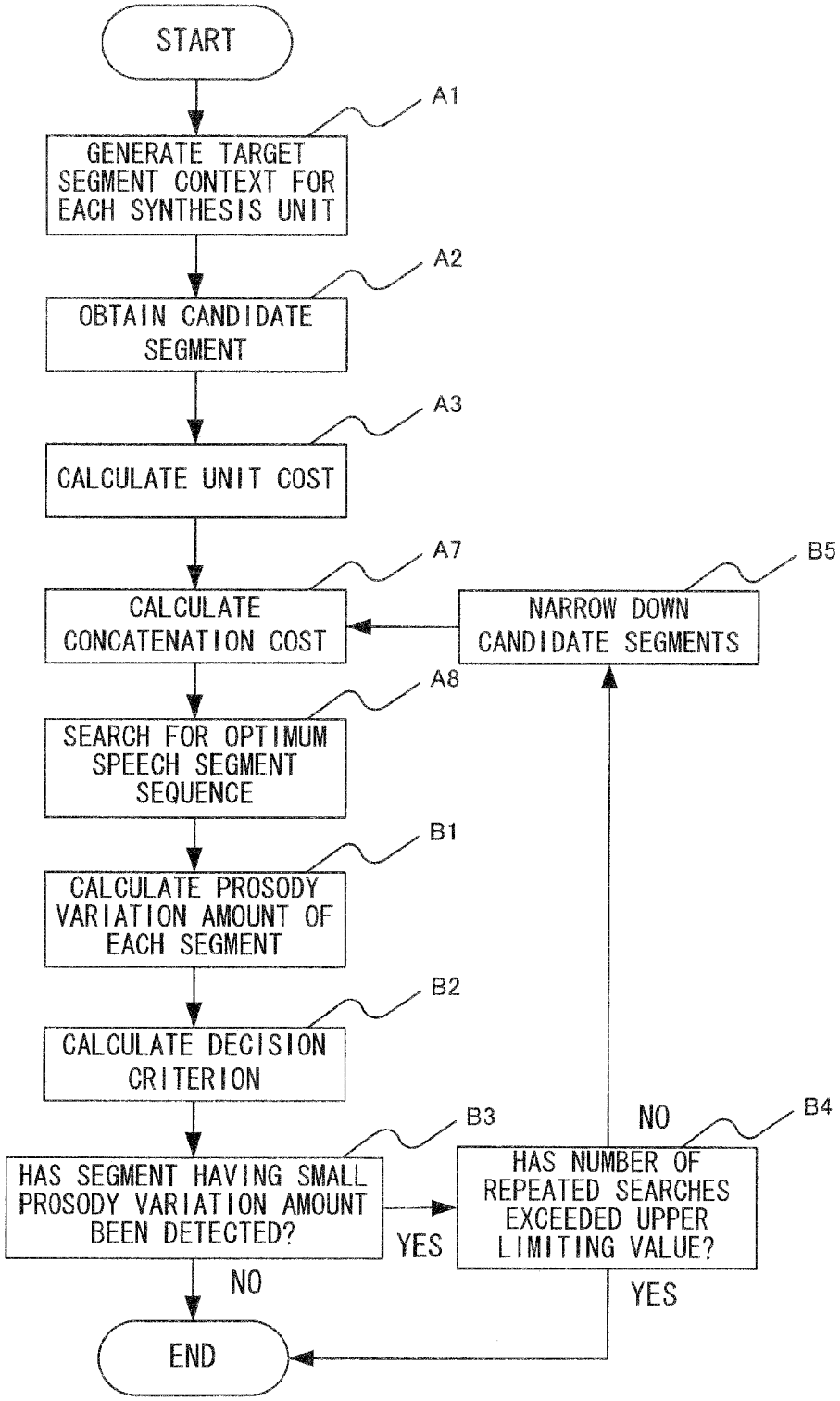
FIG. 4 is a flowchart for describing operation of the second 615 exemplary embodiment of the present invention.

FIG. 3 is a diagram showing a configuration of a second exemplary embodiment of the present invention. FIG. 4 is a flowchart for describing operation of the second exemplary embodiment of the present invention. Comparing FIG. 3 to FIG. 1, which shows a configuration of the first exemplary embodiment, the present exemplary embodiment differs from FIG. 1 in the following points.

(A) The candidate selection unit 22 is replaced by a candidate selection unit 30.

(B) The prosody change amount calculation unit 20 is replaced by a prosody change amount calculation unit 31.

(C) A decision unit 33 is newly provided.

(D) Instead of the selection criterion calculation unit 21, a selection criterion calculation unit 32 is provided.

(E) In FIG. 1, the concatenation cost calculation unit 13 is disposed between the candidate selection unit 22 and the optimum segment search unit 14. In FIG. 3, a concatenation cost calculation unit 13 is disposed between a unit cost calculating 12 and the candidate selection unit 30, and concatenation cost is calculated based on information from a unit cost calculation unit 12 (information of candidate segments and attribute information of each speech segment from a speech segment information storage unit). The candidate selection unit 30 narrows down candidates based on output from the concatenation cost calculation unit 13 and a judgment result of the decision unit 33.

(F) Furthermore, in FIG. 1, the optimum segment search unit 14 is connected to the concatenation cost calculation unit 13, and output thereof is connected to the prosody control unit 18 of the waveform generation unit 17, but in FIG. 3, an optimum segment search unit 14 is connected to the concatenation cost calculation unit 30, and output thereof is connected to the decision unit 33 and the prosody change amount calculation unit 31.

Otherwise, the present exemplary embodiment is the same as the first exemplary embodiment of FIG. 1. Below, detailed operations are described centered on these points of difference.

The prosody change amount calculation unit 31 calculates the prosody change amount of each candidate segment based on:

optimum segments output from the optimum segment search unit 14, prosody information supplied by the prosody generation unit 11, and attribute information of each optimum segment supplied by the speech segment information storage unit 15, and transmits a result to the selection criterion calculation unit 32 and the decision unit 33 (step B1).

In the present exemplary embodiment, the prosody change 1080 amount calculation unit 31 only calculates the prosody change amount of the optimum segments, not the candidate segments. This point is different from the prosody change amount calculation unit 20 of the first exemplary embodiment.

With regard to the method of calculating the prosody change amount, a method is used that is completely the same as the method used by the prosody change amount calculation unit 20 of the first exemplary embodiment.

The selection criterion calculation unit 32 calculates a selection criterion necessary for distinguishing the existence of a segment whose prosody change amount is particularly small, based on the prosody change amount of every segment supplied by the prosody change amount calculation unit 31, and the selection criterion calculation unit 32 supplies the calculated selection criterion to the decision unit 33 (step B2).

The decision unit 33 decides whether or not there exists a segment whose prosody change amount is particularly small in comparison to others, among the optimum segments.

In the present embodiment, the target of the prosody change amount used in the calculation of the selection criterion value is uniquely determined as an optimum segment. This point is different from the selection criterion calculation unit 21 of the first exemplary embodiment.

The method of calculating the selection criterion otherwise is completely the same as the method used by the selection criterion calculation unit 21 of the first exemplary embodiment.

In the present exemplary embodiment, in calculating the selection criterion, the prosody change amount of the optimum segments, selected from among the candidate segments, is used, but, similarly to the first exemplary embodiment, the prosody change amount of the candidate segments may be used. In this case, the selection criterion calculation unit 32 calculates the prosody change amount of the candidate segments, not the optimum segments.

The decision unit 33 decides whether or not there exists a segment whose prosody change amount is particularly small in comparison to others, based on an optimum segment supplied by the optimum segment search unit 14, the prosody change amount of each segment supplied by the prosody change amount calculation unit 31, and the selection criterion supplied by the selection criterion calculation unit 32 (step B3).

The decision unit 33, when it has decided that there exists a segment whose prosody change amount is particularly small in comparison to others, transmits the segment whose prosody change amount is particularly small to the candidate selection unit 30. The decision unit 33, when it is decided that there does not exist a segment whose prosody change amount is particularly small in comparison to others, transmits an optimum segment to the prosody control unit 18.

However, since there is no guarantee that an optimum segment that clears the selection criterion (judged not to exist) is supplied by the optimum segment search unit 14, it is necessary to set an upper limit to the number of times search is repeated.

Therefore, the number of times the search is repeated is recorded, and in a case where the number of times the search is repeated exceeds a prescribed upper limiting value, the optimum segment is transmitted to the prosody control unit 18 (step B4).

The decision method is the same as the method of excluding segments from the selection candidates, in the candidate selection unit 22 of the first exemplary embodiment. That is, if there exists a segment whose prosody change amount is much less than a decision criterion, it is decided that there exists a segment whose prosody change amount is particularly small.

The candidate selection unit 30 excludes one or more segments supplied by the decision unit 33 from among candidate segments supplied by the concatenation cost calculation unit 13, and transmits candidate segments that have not been excluded, and the unit cost and concatenation cost thereof to the optimum segment search unit 14 (step B5).

When there is no segment supplied from the decision unit 33, that is, before the decision unit 33 operates, since there exist no segments to be excluded, output of the concatenation cost calculation unit 13 is transmitted as it is, to the optimum segment search unit 14.

According to the present exemplary embodiment, after selection of the optimum segments, a segment whose prosody change amount is particularly small in comparison to others is detected, the detected segment is excluded from the candidate, and search is performed again.

Therefore, if completion is possible with search repeated a small number of times, the number of segments that are targets of the prosody change amount calculation is small in comparison to the first exemplary embodiment. That is, with a calculation amount less than the first exemplary embodiment, it is possible to exclude segments whose prosody change amount is small in comparison to others.

<Exemplary Embodiment 3>

Figure 5:
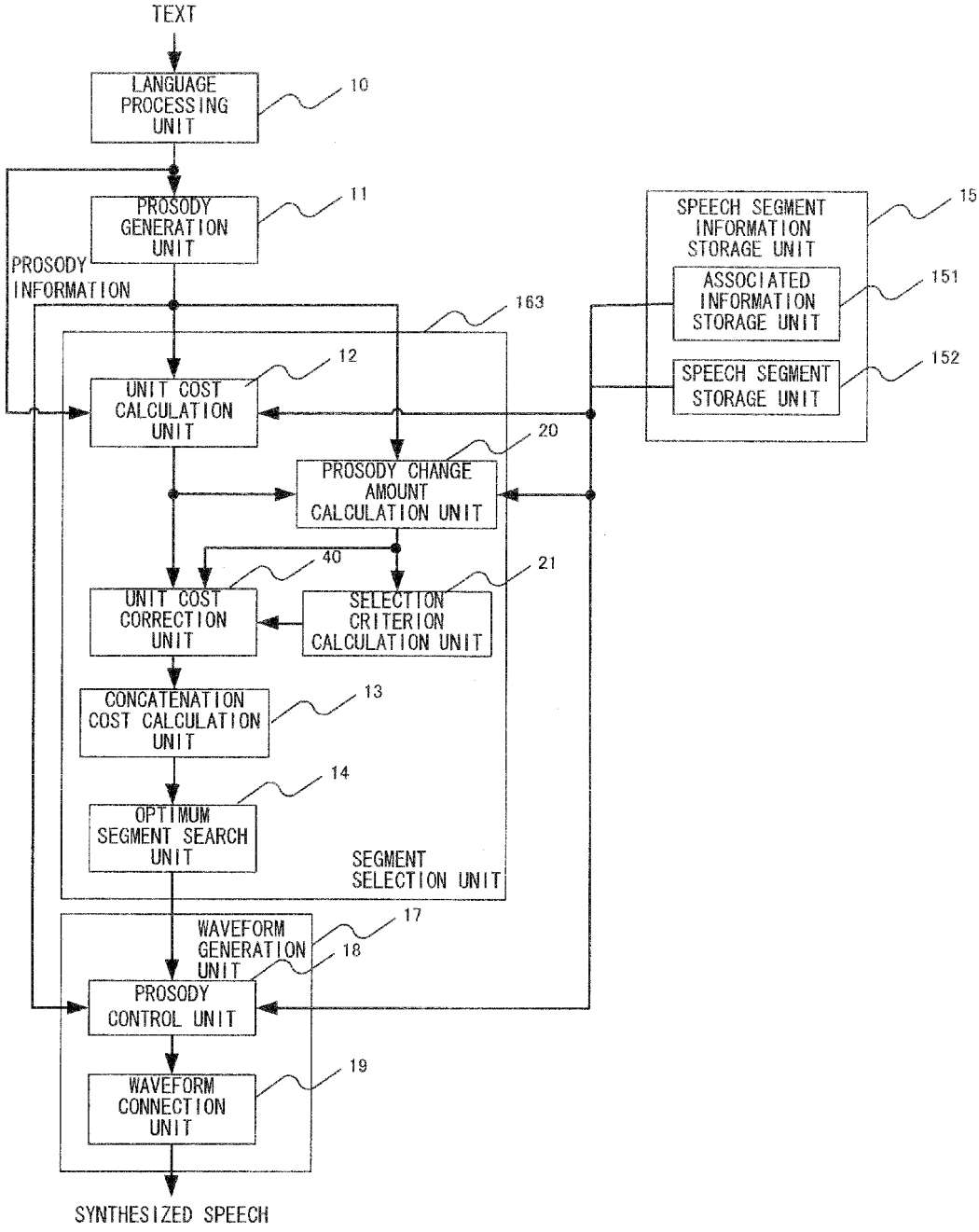
FIG. 5 is a diagram showing a configuration of a third exemplary embodiment of the present invention.
Figure 6:
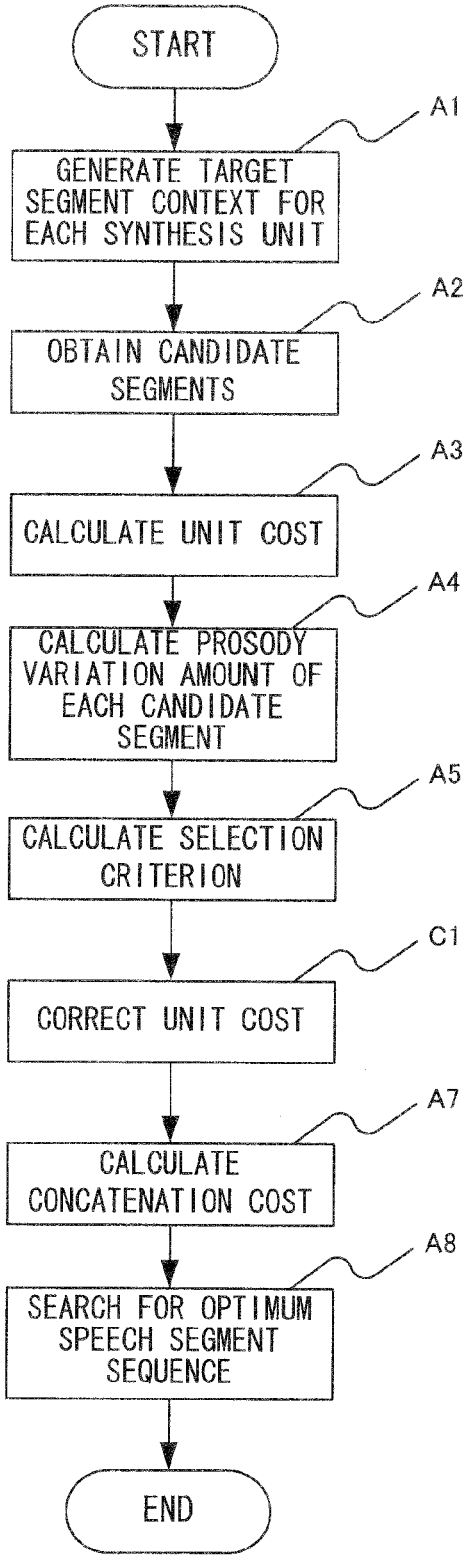
FIG. 6 is a flowchart for describing operation of the third exemplary embodiment of the present invention.

FIG. 5 is a diagram showing a configuration of a third exemplary embodiment of the present invention. FIG. 6 is a flowchart for describing operation of the third exemplary embodiment of the present invention. Comparing FIG. 5 to FIG. 1 that shows the configuration of the first exemplary embodiment, the candidate selection unit 22 of FIG. 1 is replaced by a unit cost correction unit 40. The configuration otherwise is the same as FIG. 1.

The unit cost correction unit 40 corrects unit cost of a candidate segment whose prosody change amount is small in comparison to other segments, based on a selection criterion supplied by a selection criterion calculation unit 21, the prosody change amount of the candidate segments supplied by a prosody change amount calculation unit 20, respective candidate segment information supplied by a unit cost calculation unit 12, and unit costs thereof.

The unit cost correction unit 40 transmits candidate segments and unit cost thereof to a concatenation cost calculation unit 13 (step C1).

A principal difference from the candidate selection unit 22 of the first exemplary embodiment is that, rather than being completely excluded from candidate segments, candidate segments are left as they are, with the unit cost of which a value referred to as a "penalty" is added to, and are made difficult to be selected as an optimum segment in an optimum segment search unit 14.

In the first exemplary embodiment, in a case where it is difficult to appropriately set a calculation formula of a value of a threshold $\theta$ and $\eta$, with regard to the candidate selection unit 22, it is not possible to appropriately exclude the candidate segments.

In particular, if there exists a candidate segment whose prosody change amount is sufficiently close to the threshold B but does not satisfy an exclusion criterion, there is a possibility that the candidate segment is selected as an optimum segment and an adverse effect is exerted on making the prosody change amount uniform.

If a penalty is added in accordance with size of ratio or difference between the prosody change amount and the selection criterion value of each segment, a candidate segment whose prosody change amount is sufficiently close to the threshold θ but does not satisfy an exclusion criterion in the first exemplary embodiment, can be expected to be not selected as an optimum segment in the present exemplary embodiment.

Figure 7:
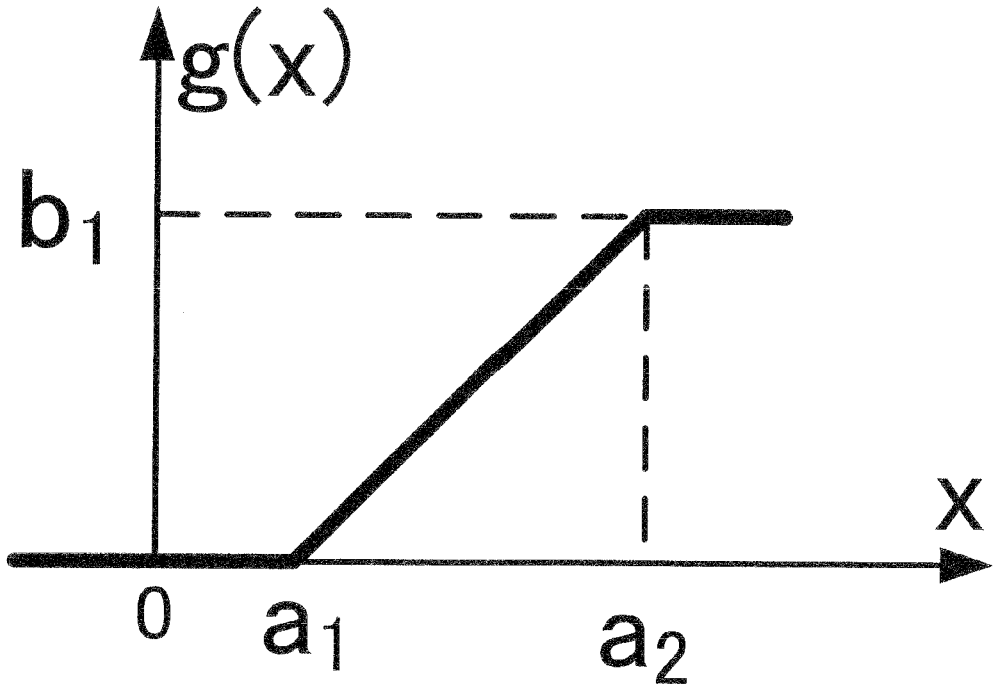
FIG. 7 is a diagram of a nonlinear function used in a unit cost correction unit shown in FIG. 5.

As a method of calculating the penalty, a method is effective in which the difference between the prosody change amount and the selection criterion value of each segment is calculated, and using a nonlinear function as shown in FIG. 7, the penalty is made large if the difference is large.

That is, if the unit cost before correction of a certain segment is C(i,j), the prosody change amount is Δp(i,j), and a selection criterion is (Li), the unit cost after correction $\tilde{C}(i,j)$ is given by the following Expression (12).

$$\tilde{C}(i,j)=C(i,j)+g(L(i)-\Delta p(i,j)) \tag{12}$$

In this regard, in a case where x is input to g(•), with the nonlinear function shown in FIG. 7, a function value g(x) is given by the following Expression (13).

$$g(x)=\begin{cases}0, & x<a_1\\ \dfrac{b_1(x-a_1)}{(a_2-a_1)}, & a_1\le x<a_2\\ b_1, & x\ge a_2\end{cases} \tag{13}$$

In this regard, $a_1$, $a_2$, and $b_1$ are positive real numbers, and $$0<a_1\le a_2,\ 0<b_1 \tag{14}$$

is satisfied.

A condition required by the nonlinear function g(x) in the above Expression (12) is that if x becomes large, g(x) does not become small (non-decreasing). Besides Expression (13), it is possible to use a liner function that satisfies this condition, a high degree polynomial, or an arbitrary function that includes weighted addition.

A method using Expression (12) is effective in a case where the prosody change amount is defined based on a difference, but in a case where the prosody change amount is defined based on a ratio, a method of calculating based on a ratio of the prosody change amount of each segment and a selection criterion value is effective.

In the case of using the ratio, if the unit cost before correction of a certain segment is C(i,j), the prosody change amount is Δp(i,j), and the selection criterion as L(i), the unit cost after correction $\tilde{C}(i,j)$ is given by the following Expression (15).

$$\tilde{C}(i,j)=\begin{cases}h\left(\dfrac{L(i)}{\Delta p(i,j)}\right)\cdot C(i,j), & \Delta p(i,j)>1.0\\ h\left(\dfrac{\Delta p(i,j)}{L(i)}\right)\cdot C(i,j), & \Delta p(i,j)\le 1.0\end{cases} \tag{15}$$

Figure 8:
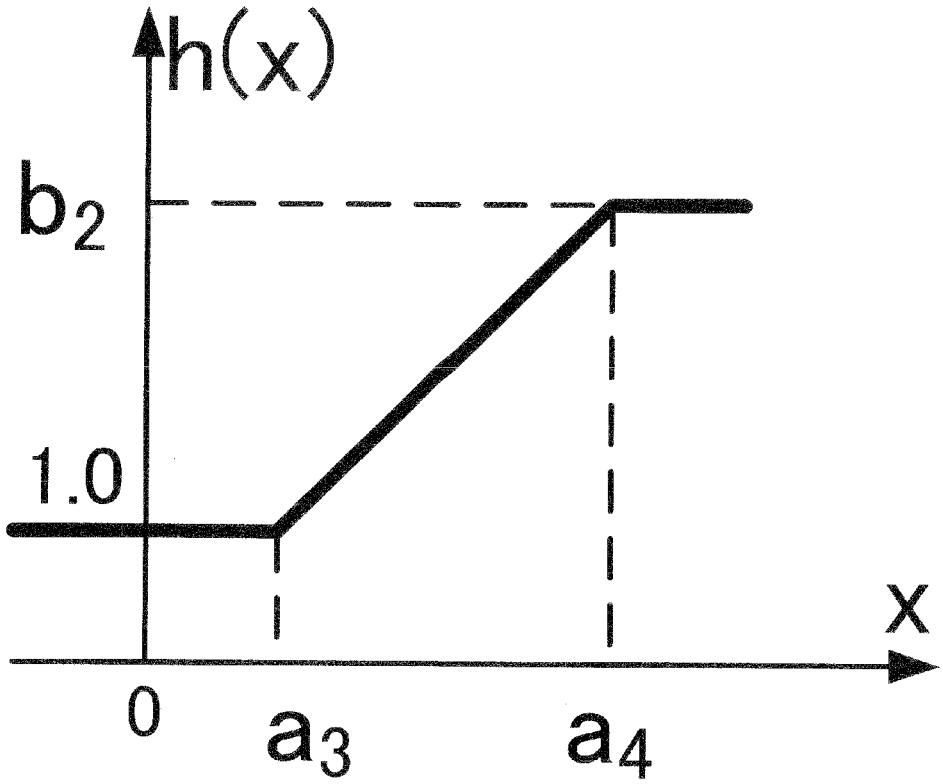
FIG. 8 is a diagram of a nonlinear function used in the unit cost correction unit shown in FIG. 5.

In this regard, in a case where x is input to h(•), with the nonlinear function shown in FIG. 8, a function value h(x) is given by the following Expression (16).

$$h(x)=\begin{cases}0, & x<a_3\\ \dfrac{b_2(x-a_3)}{(a_4-a_3)}, & a_3\le x<a_4\\ b_2, & x\ge a_4\end{cases} \tag{16}$$

In this regard, $a_3$, $a_4$, and $b_2$ are positive real numbers, and $$0<a_3\le a_4,\ 1.0<b_2 \tag{17}$$

is satisfied.

A condition similar to g(x) is also required in h(x).

In Expression (12), the penalty is given by a sum, but in Expression (15), the penalty is given by a product. As a result, a lower limiting value of the function h(x) is 1.0.

According to the present exemplary embodiment, by adding the penalty calculated based on the difference of the selection criterion value and the prosody change amount of each segment to the unit cost, the selection of the candidate segment as an optimum segment is made difficult in the optimum segment search unit 14.

As a result, a candidate segment, whose prosody change amount is sufficiently close to the threshold θ but does not satisfy art exclusion criterion, is therefore selected in an optimum segment sequence in the first exemplary embodiment, is not selected as an optimum segment in the present exemplary embodiment.

As a result, making the prosody change amount uniform is facilitated, and a sense of non-uniformity of sound quality is improved.

Furthermore, since optimum segments are not completely excluded from selection candidates, a segment that is a target for exclusion in the first exemplary embodiment may be selected in accordance with another selection criterion.

As a result, there is a possibility that the sound quality is improved in comparison to a case of complete exclusion.

The exemplified embodiments and the examples may be changed and adjusted in the scope of all disclosures (including claims) of the present invention and based on the basic technological concept thereof. In the scope of the claims of the present invention, various disclosed elements may be combined and selected in a variety of ways. That is, it is to be understood that modifications and changes that may be made by those skilled in the art according to all disclosures, including the claims, and technological concepts are included.

The invention claimed is:

1. A speech synthesizing apparatus comprising:

a storage unit that stores speech segments; and a segment selection unit that selects a segment suited to a target segment environment from among a plurality of candidate segments selected from the storage unit, wherein the segment selection unit performs control to exclude, from the candidate segment which is a candidate of the selection, a segment having a prosody change amount less than a selection criterion that is determined based on a prosody change amount of the candidate segments.

2. The speech synthesizing apparatus according to claim 1, wherein the segment selection unit comprises:

a prosody change amount calculation unit that calculates a prosody change amount of each candidate segment, based on prosody information of the target segment environment and the candidate segments;

a selection criterion calculation unit that calculates a selection criterion, based on the prosody change amount;

a candidate selection unit that narrows down selection candidates, based on the prosody change amount and the selection criterion; and an optimum segment search unit that searches for an optimum segment from among the narrowed-down candidate segments;

wherein the candidate selection unit excludes, from selection candidates, a segment having a prosody change amount less than the selection criterion, and excludes the segment from a target of search for an optimum segment by the optimum segment search unit.

3. The speech synthesizing apparatus according to claim 2, wherein the selection criterion calculation unit comprises:

a cost calculation unit that calculates a cost of each candidate segment based on the target segment environment and a segment environment of the candidate segments; and calculates the selection criterion based on the cost.

4. The speech synthesizing apparatus according to claim 1, wherein the segment selection unit comprises:

an optimum segment search unit that searches for optimum segments based on the target segment environment and a segment environment of the candidate segments;

a prosody change amount calculation unit that calculates a prosody change amount of each candidate segment, based on prosody information of the target segment environment and the candidate segments;

a selection criterion calculation unit that calculates a selection criterion based on the prosody change amount; and a decision unit that decides, in a case where, among the optimum segments, there exists a segment having a prosody change amount less than the selection criterion, that re-execution of search for an optimum segment is necessary;

wherein in a case where the decision unit decides that the re-execution of the search for an optimum segment is necessary, the optimum segment search unit re-executes the search for an optimum segment.

5. The speech synthesizing apparatus according to claim 4, wherein the prosody change amount calculation unit calculates the prosody change amount for only the optimum segments.

6. The speech synthesizing apparatus according to claim 4, wherein the optimum segment search unit excludes segments that do not satisfy the selection criterion from candidates, and re-executes search for optimum segments.

7. The speech synthesizing apparatus according to claim 1, wherein the segment selection unit comprises:

a prosody change amount calculation unit that calculates a prosody change amount of each candidate segment, based on prosody information of the target segment environment and the candidate segments;

a selection criterion calculation unit that calculates a selection criterion from the prosody change amount;

a unit cost calculation unit that calculates a unit cost of each candidate segment based on the target segment environment and a segment environment of the candidate segments; and an optimum segment search unit that searches for an optimum segment from among candidate segments based on the unit cost;

wherein the unit cost calculation unit assigns a penalty to a unit cost of a segment having a prosody change amount less than the selection criterion.

8. The speech synthesizing apparatus according to claim 7, wherein the unit cost calculation unit determines the penalty, the penalty being made larger in accordance with increase in a difference between the prosody change amount and the selection criterion.

9. The speech synthesizing apparatus according to claim 2, wherein the selection criterion calculation unit determines the selection criterion based on an average value of the prosody change amount.

10. The speech synthesizing apparatus according to claim 2, wherein the selection criterion calculation unit determines the selection criterion based on a value obtained by smoothing the prosody change amount in a time domain.

11. A speech synthesizing method comprising:

providing a non-transitory storage unit, coupled to a processor, that stores speech segments;

providing a segment selection unit;

selecting a plurality of candidate segments for a target segment environment from the storage unit that stores speech segments; and selecting with the segment selection unit a segment suited to the target segment environment from among a plurality of candidate segments, wherein the step of selecting the segment comprises performing control to exclude, from the candidate segment which is a candidate of the selection, a segment that has a prosody change amount less than a selection criterion determined based on a prosody change amount of the candidate segments.

12. The speech synthesizing method according to claim 11, wherein the step of selecting the segment comprises:

calculating a prosody change amount of each candidate segment, based on prosody information of the target segment environment and the candidate segments;

calculating a selection criterion based on the prosody change amount;

narrowing down selection candidates, based on the prosody change amount and the selection criterion; and searching for an optimum segment from among the narrowed-down candidate segments;

wherein the step of narrowing down the candidate selection comprises excluding, from the selection candidates, a segment that has a prosody change amount less than the selection criterion.

13. A non-transitory computer-readable recording medium storing a program that causes a computer which constitutes a speech synthesizing apparatus, to execute:

a processing of selecting a plurality of candidate segments for a target segment environment from a storage unit that stores speech segments; and a processing of selecting a segment suited to a target segment environment from among a plurality of candidate segments, wherein the processing of selecting the segment comprises: performing control excluding, from the candidate segment which is a candidate of the selection, a segment that has a prosody change amount less than a selection criterion that is determined based on a prosody change amount of candidate segments.

14. The recording medium according to claim 13, wherein the processing of selecting the segment comprises:

a processing of calculating a prosody change amount of each candidate segment, based on prosody information of the target segment environment and the candidate segments;

a processing of calculating a selection criterion based on the prosody change amount;

a processing of narrowing down selection candidates, based on the prosody change amount and the selection criterion; and a processing of searching for an optimum segment from among the narrowed-down candidate segments;

wherein the processing of narrowing down the selection candidates comprises: a processing of excluding, from the candidates, a segment that has a prosody change amount less than the selection criterion.

15. The speech synthesizing apparatus according to claim 2, wherein a selection criterion used by the candidate selection unit is determined in advance, or is input from outside the speech synthesizing apparatus, and there is no necessity to compute a selection criterion based on the prosody change amount by the selection criterion calculation unit.

16. The speech synthesizing apparatus according to claim 1, further comprising, in addition to the segment selection unit:

a language processing unit that generates a language processing result including a symbol sequence representing a reading from text, and morphological part of speech, conjugation, and accent information;

a prosody generation unit that generates prosody information of synthesized speech generated based on the language processing result;

a prosody control unit that generates a waveform having a prosody generated by the prosody generation unit, from speech segments selected by the segment selection unit;

a waveform connection unit that concatenates speech segments output by the prosody control unit, to output the result as synthesized speech; and a speech segment information storage unit that stores speech segments divided into synthesis units and attribute information of each speech segment;

wherein the segment selection unit comprises:

a unit cost calculation unit that receives the language processing result generated by the language processing unit, and prosody information generated by the prosody generation unit, generates the target segment environment for each synthesis unit, selects, as candidate segments, a plurality of speech segments matching information designated by the target segment environment, from the speech segment information storage unit, and, calculates a unit cost of each candidate segment, based on segment environment of the candidate segments and the target segment environment;

a prosody change amount calculation unit that calculates prosody change amount of each candidate segment, based on the prosody information, the unit cost of a plurality of candidate segments, and attribute information of each speech segment from the speech segment information storage unit;

a selection criterion calculation unit that calculates a selection criterion for candidates necessary for narrowing down candidate segments, based on prosody change amount of each of the candidate segments;

a candidate selection unit that narrows down candidate segments, based on the selection criterion from the selection criterion calculation unit, the prosody change amount from the prosody change amount calculation unit, and the unit cost and information of each candidate segment from the unit cost calculation unit, and excludes, from candidates, a segment of which the prosody change amount is small compared to others, based on the selection criterion, from among candidate segments of which the unit cost is relatively low, and outputs information of the narrowed-down and selected candidate segments and unit cost thereof;

a concatenation cost calculation unit that calculates concatenation cost of each of the candidate segments, based on information of each of the candidate segments, and attribute information of each speech segment from the speech segment information storage unit; and an optimum segment search unit that obtains, based on information of the candidate segments, the unit cost, and the concatenation cost, an optimum segment sequence, which is a speech segment sequence in which an objective function related to the unit cost and the concatenation cost is optimized, to be provided to the prosody control unit.

17. The speech synthesizing apparatus according to claim 1, further comprising, in addition to the segment selection unit:

a language processing unit that generates a language processing result including a symbol sequence representing a of synthesized speech generated based on the language processing reading from text, and morphological part of speech, conjugation, and accent information;

a prosody generation unit that generates prosody information result;

a prosody control unit that generates a waveform having a prosody generated by the prosody generation unit, from speech segments selected by the segment selection unit;

a waveform connection unit that concatenates speech segments output by the prosody control unit, to output the result as synthesized speech; and a speech segment information storage unit that stores speech segments divided into synthesis units and attribute information of each speech segment;

wherein the segment selection unit comprises:

a unit cost calculation unit that receives the language processing result generated by the language processing unit, and the prosody information generated by the prosody generation unit, generates the target segment environment for each synthesis unit, selects, as candidate segments, a plurality of speech segments matching information designated by the target segment environment, from the speech segment information storage unit, and, calculates a unit cost of each candidate segment, based on a segment environment of the candidate segments and the target segment environment;

a concatenation cost calculation unit that calculates concatenation cost of each of the candidate segments, based on information of each of the candidate segments, and attribute information of each speech segment from the speech segment information storage unit;

a candidate selection unit that narrows down candidate segments, based on information of each of the candidate segments, the unit cost and the concatenation cost, and outputs information of the narrowed-down and selected candidate segments and unit cost thereof;

an optimum segment search unit that obtains, based on information of the candidate segments, the unit cost, and the concatenation cost, an optimum segment sequence, which is a speech segment sequence in which an objective function related to the unit cost and the concatenation cost is optimized, to be provided to the prosody control unit;

a prosody change amount calculation unit that calculates prosody change amount of optimum segments in question, based on each segment of the optimum segment sequence output from the optimum segment search unit, the prosody information from the prosody generation unit, and attribute information of the optimum segments from the speech segment information storage unit;

a selection criterion calculation unit that calculates a selection criterion necessary for distinguishing existence of a segment whose prosody change amount is particularly small in comparison to others, based on prosody change amount of each optimum segment from the prosody change amount calculation unit; and a decision unit that decides whether or not there exists a segment whose prosody change amount is particularly small in comparison to others, based on optimum segments from the optimum segment search unit, prosody change amount of each segment from the prosody change amount calculation unit, and a selection criterion supplied from the selection criterion calculation unit, in a case where it is decided that there exists a segment whose prosody change amount is particularly small in comparison to others, supplies a segment whose prosody change amount is particularly small to the candidate selection unit, the candidate selection unit re-executing search of candidate segments, and in a case where it is decided that there does not exist a segment whose prosody change amount is particularly small in comparison to others, or in a case where the number of times the search is repeated exceeds an upper limit, and supplies optimum segments to the prosody control unit;

wherein the candidate selection unit excludes, a segment supplied from the decision unit, from among the candidate segments supplied from the concatenation cost calculation unit, and supplies a candidate segment that is not excluded, and unit cost and concatenation cost of the candidate segment to the optimum segment search unit.

18. The speech synthesizing apparatus according to claim 1, further comprising, in addition to the segment selection unit:

a language processing unit that generates a language processing result including a symbol sequence representing a reading from text, and morphological part of speech, conjugation, and accent information;

a prosody generation unit that generates prosody information of synthesized speech generated based on the language processing result;

a prosody control unit that generates a waveform having a prosody generated by the prosody generation unit, from speech segments selected by the segment selection unit;

a waveform connection unit that concatenates speech segments output by the prosody control unit, to output the concatenated as synthesized speech; and a speech segment information storage unit that stores speech segments divided into synthesis units and attribute information of each speech segment;

wherein the segment selection unit comprises:

a unit cost calculation unit that receives the language processing result generated by the language processing unit, and the prosody information generated by the prosody generation unit, generates the target segment environment for each synthesis unit, selects, as candidate segments, a plurality of speech segments matching information designated by the target segment environment, from the speech segment information storage unit, and, calculates a unit cost of each candidate segment, based on a segment environment of the candidate segments and the target segment environment;

a prosody change amount calculation unit that calculates prosody change amount of each candidate segment, based on the prosody information, the unit cost of each of the plurality of candidate segments, and attribute information of each speech segment from the speech segment information storage unit;

a selection criterion calculation unit that calculates a selection criterion for candidates necessary for narrowing down candidate segments, based on prosody change amount of each of the candidate segments;

a unit cost correcting unit that corrects a unit cost of a candidate segment of which the prosody change amount is small in comparison to other segments, based on the selection criterion from the selection criterion calculation unit, the prosody change amount of candidate segments supplied from the prosody change amount calculation unit, and the unit cost and information of each candidate segment supplied from the unit cost calculation unit;

a concatenation cost calculation unit that calculates concatenation cost of each candidate segment, based on information of each of the candidate segments, and the attribute information of each speech segment from the speech segment information storage unit; and an optimum segment search unit that obtains, based on information of the candidate segments, the unit cost, and the concatenation cost, an optimum segment sequence, which is a speech segment sequence in which an objective function related to the unit cost and the concatenation cost is optimized, to be provided to the prosody control unit.

* * * * *

UNITED STATES PATENT AND TRADEMARK OFFICE

CERTIFICATE OF CORRECTION

PATENT NO. : 8,630,857 B2
APPLICATION NO. : 12/527802
DATED : January 14, 2014
INVENTOR(S) : Kato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1184 days.

Signed and Sealed this
Twenty-second Day of September, 2015

Michelle K. Lee

Michelle K. Lee
*Director of the United States Patent and Trademark Office*